US008544774B1

(12) United States Patent
Harbold et al.

(10) Patent No.: US 8,544,774 B1
(45) Date of Patent: Oct. 1, 2013

(54) ROLLER CRUSHER, AND METHOD OF PROTECTING A ROLLER CRUSHER FROM UNCRUSHABLE OBJECTS

(75) Inventors: Keith Harbold, York, PA (US); Vadim Reznitchenko, Mechanicsburg, PA (US)

(73) Assignee: Metso Minerals Industries, Inc., Waukesha, WI (US)

( * ) Notice: Subject to any disclaimer, the term of this patent is extended or adjusted under 35 U.S.C. 154(b) by 1 day.

(21) Appl. No.: 13/451,895

(22) Filed: Apr. 20, 2012

(51) Int. Cl.
*B02C 25/00* (2006.01)

(52) U.S. Cl.
USPC ..... 241/30; 241/34; 241/37

(58) Field of Classification Search
USPC ..... 241/30, 34, 37, 230, 231, 234, 235
See application file for complete search history.

(56) References Cited

U.S. PATENT DOCUMENTS

| | | | | |
|---|---|---|---|---|
| 3,468,488 | A * | 9/1969 | Linzberger et al. | 241/34 |
| 3,606,265 | A * | 9/1971 | Cobey et al. | 241/231 |
| 4,140,285 | A * | 2/1979 | Linzberger et al. | 241/232 |
| 5,060,874 | A * | 10/1991 | Sidney et al. | 241/231 |
| 5,078,327 | A * | 1/1992 | Kemetter | 241/36 |
| 5,205,019 | A * | 4/1993 | Schnlichter et al. | 19/200 |
| 5,263,651 | A * | 11/1993 | Nadarajah | 241/28 |
| 5,485,965 | A * | 1/1996 | Hostettler et al. | 241/29 |
| 5,568,896 | A * | 10/1996 | Adams et al. | 241/24.29 |
| 5,865,382 | A * | 2/1999 | Bielagus | 241/28 |
| 2012/0001001 | A1* | 1/2012 | Schwelling | 241/25 |
| 2013/0001337 | A1* | 1/2013 | Sjoberg et al. | 241/27 |

FOREIGN PATENT DOCUMENTS

WO 98/32911 A1 7/1998

* cited by examiner

*Primary Examiner* — Dana Ross
*Assistant Examiner* — Leonel Vasquez
(74) *Attorney, Agent, or Firm* — Andrus, Sceales, Starke & Sawall, LLP

(57) ABSTRACT

A method of protecting a roller crusher, having two rollers separated by a gap, from uncrushable objects is disclosed. The method includes the steps of:

detecting an uncrushable object in an in-feed stream of material, opening a gap between the rollers to a by-pass width, which is significantly larger than an operational width, such that the uncrushable object is permitted to pass through the gap, restricting an in-feed to the gap, such that material is fed to the gap at a restricted in-feed rate, determining that the uncrushable object has passed through the gap, reducing the gap to the operational width, and opening the in-feed to the gap, such that material is fed to the gap at an operational in-feed rate. A roller crusher having a protective system for protecting the roller crusher from uncrushable objects is also disclosed.

15 Claims, 3 Drawing Sheets

(Prior art) Fig. 1

ROLLER CRUSHER, AND METHOD OF PROTECTING A ROLLER CRUSHER FROM UNCRUSHABLE OBJECTS

TECHNICAL FIELD OF THE INVENTION

The present invention relates to a method of protecting a roller crusher from uncrushable objects. Further, the present invention relates to a roller crusher having a protective system for protection from uncrushable objects.

BACKGROUND ART

When crushing or grinding rock, ore, cement clinker and other hard materials, roller crushers may be used having two generally parallel rolls which rotate in opposite directions and which are separated by a gap. The material to be crushed is fed by gravity or choke-fed into the gap. One type of roller crusher is called high pressure grinding rollers or high pressure roller crushers. This type of roller crusher uses a crushing technique called interparticle crushing. Here, the material to be crushed or pulverised is crushed, not only by the crushing surface of the rolls, but also by particles in the material to be crushed, hence the name interparticle crushing. One example of a high pressure grinding roller is described in EP-516 952.

A problem which arises in roller crushers is that sometimes objects which are not possible to crush by the roller crusher are present in the in-feed stream of material. If an uncrushable object is fed into the gap of the roller crusher, the rollers and the system holding the rollers may be damaged, causing costs associated with down-time and repair. Therefore, roller crushers are sometimes provided with protective systems for protecting the roller crusher from uncrushable objects. In one known system, shown in FIG. 1, a metal detector 111 is provided at the in-feed 104 to the roller crusher 101. When the metal detector 111 detects an uncrushable object, a by-pass chute 118 is opened, such that the in-feed stream is diverted and by-passes the gap 103 between the rollers 102. The by-pass stream is led to the same discharge chute 110 as crushed material leaving the crushing gap 103. A problem with this solution is that during by-pass mode, the discharge chute 110 receives at least twice the amount of material per unit of time as during normal operation, since the flow of the by-pass stream is added to the flow of crushed material. If several by-pass events occur within a short period of time, the discharge chute 110 is overloaded, or else it has to be severely over dimensioned in relation to the normal operational flow of crushed material. Another problem is that the use of a by-pass chute 118 makes the roller crusher 101 space-requiring. Further, since the by-pass chute 118 is to discharge the by-passed material in the discharge chute 110, the discharge chute 110 needs to be placed at a distance from the exit of the gap 103, thereby adding to the space requirement of the roller crusher 101. Thus, a need remains for an improved method of protecting a roller crusher from uncrushable objects, and for a roller crusher having an improved protective system for protection from uncrushable objects.

SUMMARY OF THE INVENTION

It is an object of the present invention to overcome, or at least lessen, the above-mentioned problems.

A particular object is to provide a method of protecting a roller crusher from uncrushable objects, which makes it possible to protect the roller crusher without adding to the size of it.

Another object is to provide a roller crusher which may be protected from uncrushable objects without having to use a space-requiring by-pass chute.

According to a first aspect, these and other objects are achieved, in full or at least in part, by a method of protecting a roller crusher from uncrushable objects, said roller crusher having two generally parallel rollers arranged to rotate in opposite directions and separated by a gap, said method comprising the steps of:

detecting an uncrushable object in an in-feed stream of material to said roller crusher, opening a gap between said rollers to a by-pass width, which is significantly larger than an operational width, such that said uncrushable material is permitted to pass through said gap, restricting an in-feed to said gap, such that material is fed to said gap at a restricted in-feed rate, determining that said uncrushable object has passed through said gap, reducing said gap to said operational width, and opening said in-feed to said gap, such that material is fed to said gap at an operational in-feed rate. Such a method makes it possible to protect a roller crusher from uncrushable objects, without having to use a cumbersome by-pass chute. Further, the restriction of the in-feed rate makes it possible to gain some time for opening the gap, such that the roller crusher may be more securely protected. Determining when the uncrushable object has passed through the gap enables a quick return to normal operation.

In a variant of the method, the uncrushable object comprises metal. Metallic objects are a common type of uncrushable objects which may damage the roller crusher seriously, and they are relatively easy to detect.

The by-pass width may be greater than or equal to three times said operational width. Opening the gap to at least three times the operational width makes it possible to permit most uncrushable objects to pass unhindered through the gap.

The restricted in-feed rate may be 30-50% of said operational in-feed rate. In this manner, a suitable in-feed rate may be ensured.

In a variant of the method, determining that said uncrushable object has passed through said gap comprises detecting said uncrushable object in a discharge stream of material from said roller crusher. Thereby, it may be ascertained that the uncrushable object has actually passed the gap, and normal operation of the roller crusher may safely be resumed.

According to a second aspect, these and other objects are achieved, in full or at least in part, by a roller crusher having two generally parallel rollers arranged to rotate in opposite directions and separated by a gap, said roller crusher comprising an in-feed arrangement arranged to feed material to said roller crusher, a control gate arranged to control an in-feed rate to said gap, a first detector arranged to detect uncrushable objects, a gap adjuster arranged to adjust a width of said gap, and a control unit arranged to receive at least one input signal from said first detector, and to transmit at least one output signal to said control gate and to said gap adjuster. By this arrangement, the roller crusher is provided with a protective system that makes it possible to protect the roller crusher from uncrushable objects, without having to use a cumbersome by-pass chute. The control gate makes it possible to gain some time for opening the gap, such that the roller crusher may be more securely protected.

In an embodiment, the first detector is a metal detector. A metal detector may be used for detecting metallic objects, which are a common type of uncrushable objects that may damage the roller crusher seriously.

The roller crusher may comprise a second detector arranged to detect uncrushable objects. The second detector may be used for detecting the uncrushable object in a discharge stream of material from said roller crusher.

The second detector may be a metal detector. Thereby, metallic objects may be securely detected.

In an embodiment, the first detector is arranged to detect uncrushable objects in an in-feed stream of material to said roller crusher, and the second detector is arranged to detect uncrushable objects in a discharge stream of material from said roller crusher. This is advantageous in that it makes it possible to detect when an uncrushable object is about to enter the gap of the roller crusher, and to detect when the uncrushable object has passed through the gap.

The gap adjuster may be arranged to adjust said gap in a width range from an operational width to a by-pass width, which is significantly larger than said operational width, preferably greater than or equal to three times said operational width. In this manner, it is possible to permit most uncrushable objects to pass unhindered through the gap.

The control gate may be arranged to control said in-feed rate in a range from a restricted in-feed rate to an operational in-feed rate, said restricted in-feed rate being 30-50% of said operational in-feed rate. In this manner, a suitable in-feed rate may be ensured.

In an embodiment, the control unit is arranged to transmit a first output signal to said control gate, and to transmit a second output signal to said gap adjuster. Thereby, different control signals may be sent to the control gate and the gap adjuster.

The control gate may be hydraulically operable, as may the gap adjuster. Hydraulic operation may be reliable and quick.

Other objectives, features and advantages of the present invention will appear from the following detailed disclosure, from the attached claims, as well as from the drawings. It is noted that the invention relates to all possible combinations of features.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise. The steps of any method disclosed herein do not have to be performed in the exact order disclosed, unless explicitly stated.

As used herein, the term "comprising" and variations of that term are not intended to exclude other additives, components, integers or steps.

BRIEF DESCRIPTION OF THE DRAWINGS

The invention will be described in more detail with reference to the appended schematic drawings, which show an example of a presently preferred embodiment of the invention.

DETAILED DESCRIPTION OF PREFERRED EMBODIMENTS OF THE INVENTION

Figure 1:
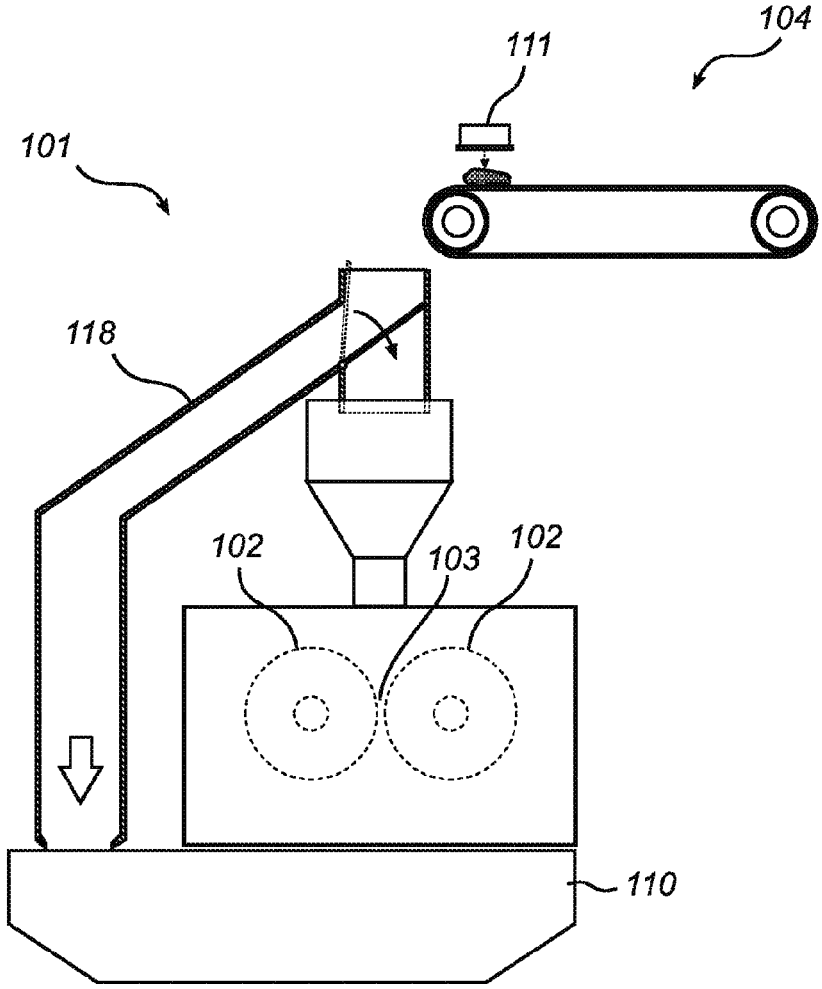
FIG. 1 is a side view showing a roller crusher according to prior art.

With reference to FIG. 1, a roller crusher 1 has two rollers 2, which extend horizontally and are arranged in parallel. Between them, the rollers define a crushing gap 3. The roller crusher 1 further comprises an in-feed arrangement 4, arranged above the rollers 2, including a conveyor 5, a hopper 6, a control gate 7, and guide plates 8. The roller crusher 1 also comprises a discharge arrangement 9, arranged below the rollers 2, including a discharge chute 10. At a position adjacent the conveyor 5, a first metal detector 11 is arranged, and at a position adjacent the discharge chute 10, a second metal detector 12 is arranged.

The control gate 7 is constructed as a funnel having two pivotable sidewalls 13. Each sidewall is connected to a respective hydraulic cylinder 14.

The roller crusher is provided with a gap adjuster 15 in the form of a hydraulic cylinder 16 connected to the rollers 2.

Further, the roller crusher 1 comprises a control unit 17 operably connected to the first and second metal detectors 11, 12, to the control gate 7, and to the gap adjuster 15. The connection may be by wiring or wireless.

The operation of the roller crusher 1 will now be described. Material M to be ground is fed by the conveyor 5 to the hopper 6. The material M to be ground or crushed passes through the control gate 7 and between the guide plates 8 to the gap 3 between the rollers. For high pressure roller crushing, the material M to be ground is choke fed to the gap 3, i.e. pressure is added on the material currently being fed to the crushing gap by gravity acting on material above it. The material M is crushed and ground by crushing action of the rollers 2 and also by crushing action of particles in the material M itself, so called interparticle crushing.

The roller crusher 1 has a protective system, which may be referred to as a tramp protection system. The method by which the roller crusher 1 is protected from tramp objects, i.e. uncrushable objects, will now be described.

Figure 2:
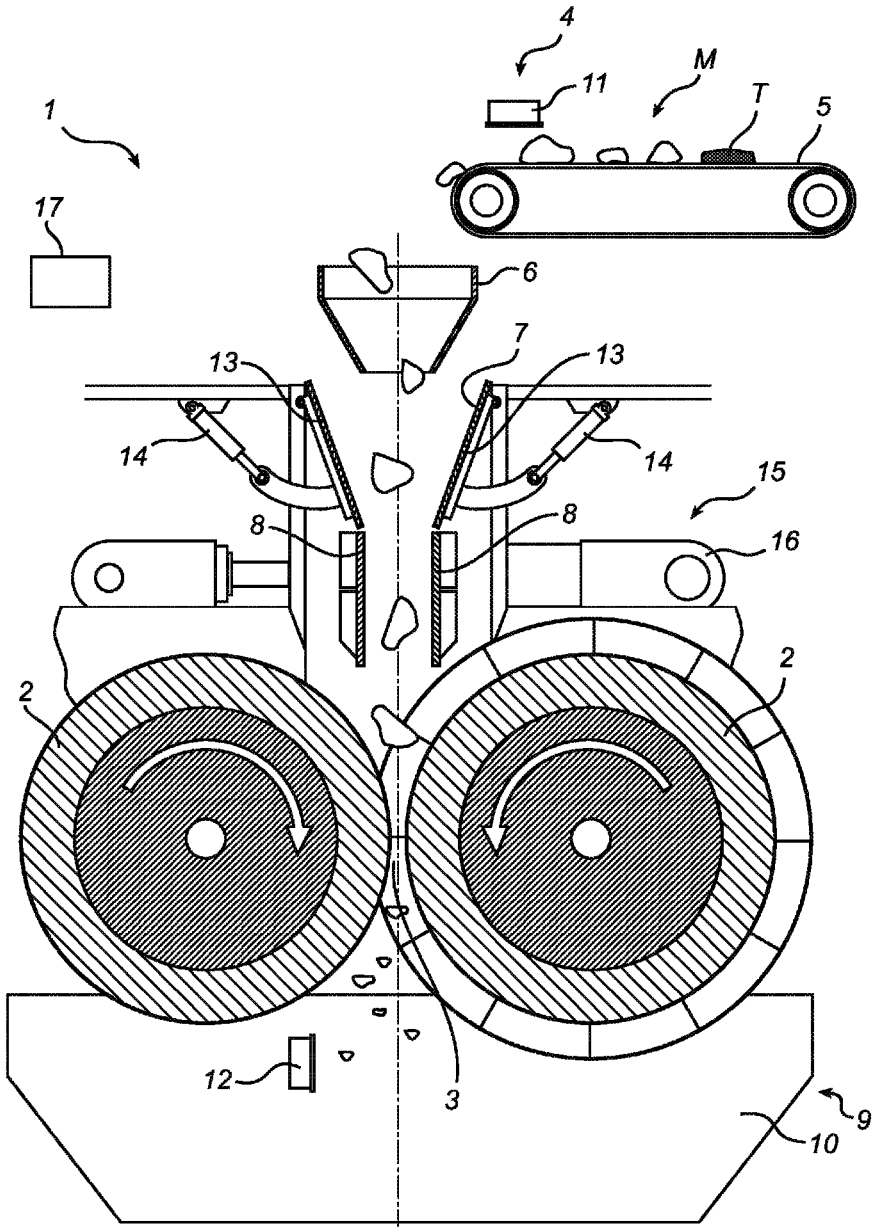
FIG. 2 is a side view showing an embodiment of a roller crusher during normal operation.
Figure 3:
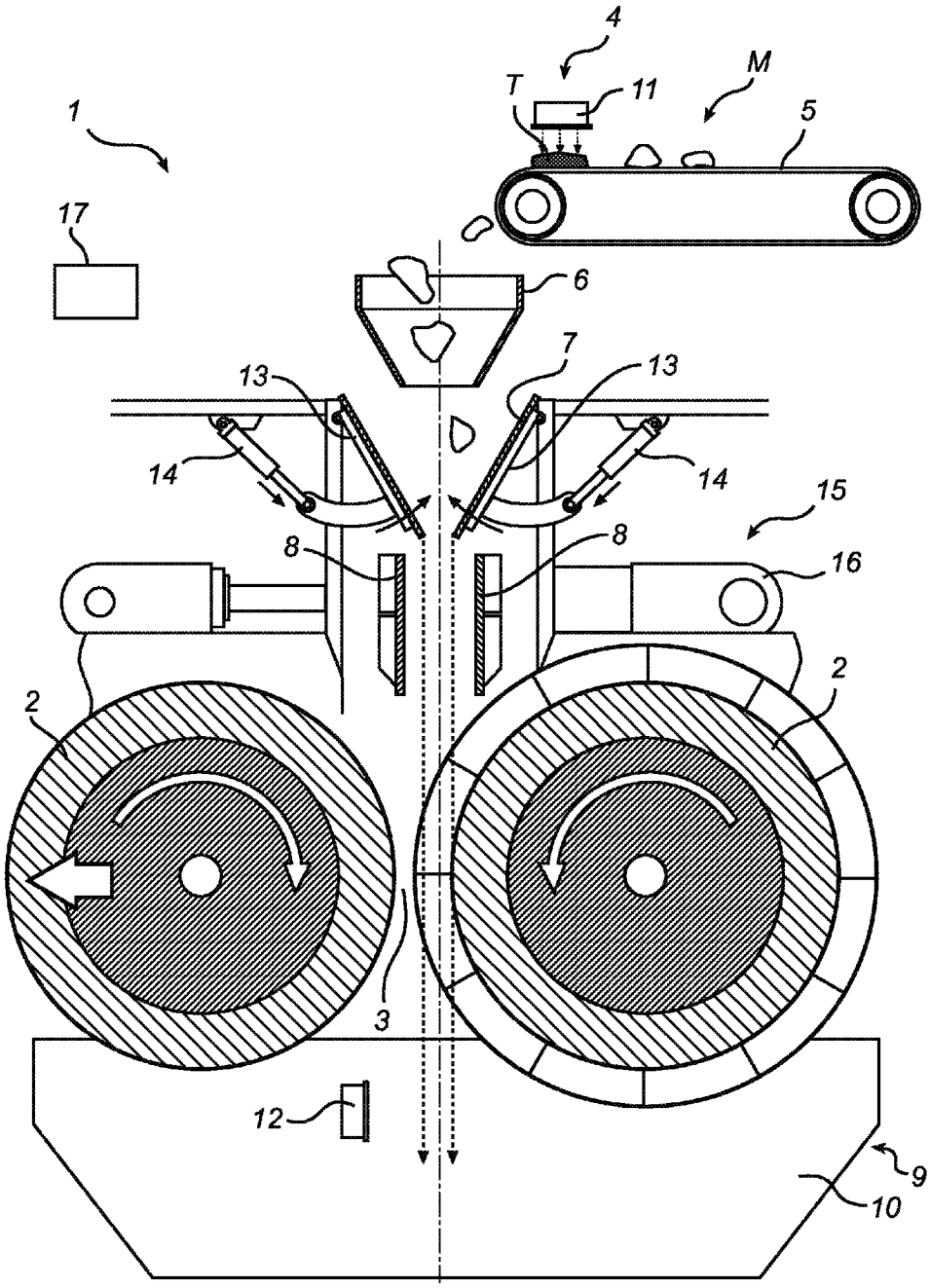
FIG. 3 is a side view showing the roller crusher of FIG. 2 during a by-pass mode.

In the example shown, an uncrushable object or tramp object T is present in the in-feed stream of material M. In this example, the uncrushable object T is of metallic character. Turning to FIG. 2, when the uncrushable object T passes the first metal detector 11, the uncrushable object T is detected by the first metal detector 11. The first metal detector 11 sends a first input signal to the control unit 17 indicating that an uncrushable object T has been detected. In response to the first input signal, the control unit sends a first output signal to the hydraulic cylinders 14 of the control gate, prompting them to extend, thereby pivoting the pivotable side walls 13 such that they reduce the lower opening of the control gate 7. Thereby, the in-feed rate to the gap 3 is reduced from an original operational in-feed rate to a restricted in-feed rate. The restricted in-feed rate may be, e.g., 30-50% of the operational in-feed rate. Additionally, the control unit 17 sends a second output signal to the gap adjuster 15, prompting the hydraulic cylinder 16 of the gap adjuster 15 to extend, thereby moving the rollers 2 apart, and hence, widening the gap 3 from an original operational width to a greater by-pass width. The by-pass width may be, e.g., three times the operational width.

By widening the gap 3 to the by-pass width, the uncrushable object T is allowed to pass through the gap 3. The rollers 2 will not attempt to crush the uncrushable object, and thereby, the rollers 2 are protected from the uncrushable object T.

By reducing the opening of the control gate 7, the in-feed rate to the gap is reduced, and thereby time may be gained for being able to protect the rollers from the uncrushable object T, and less material M is allowed to pass uncrushed through the gap 3.

If the uncrushable object T is small enough, it will pass through the control gate 7 even though the opening of the control gate 7 is reduced. However, since the crushing gap 3 is widened, the uncrushable object T will pass through the gap 3 without damaging the rollers 2. Should the uncrushable object T be too large to pass through the control gate 7 when the opening is reduced, then the opening of the control gate 7 may be increased again once the width of the crushing gap 3 has been increased to the by-pass width, such that the uncrushable object T may pass through the control gate 7, and then through the crushing gap 3 without damaging the rollers 2.

The roller crusher 1 may be further adapted to protect the rollers from uncrushable objects T by decreasing the pressure with which the rollers 2 are pressed towards each other. To this end, the roller crusher 1 may be provided with a pressure adjuster (not shown). In this manner, if an overly large or unsymmetrical uncrushable object T enters the gap when it has been widened to the by-pass width, the uncrushable object T may be allowed to push one of the rollers 2 away from the other, or the rollers 2 away from each other, thereby increasing the width of the gap 3 further, such that the uncrushable object T may pass through. Once the uncrushable object T has passed through the gap 3, the pressure applied to the rollers 2 may once more be increased to an operational pressure.

When the uncrushable object T has passed through the gap 3, the second metal detector 12 detects the uncrushable object T. The second metal detector 12 sends a second input signal to the control unit 17. In response thereto, the control unit 17 sends a third output signal to the control gate 7, prompting the hydraulic cylinders 14 to retract, thereby pivoting the pivotable side walls 13 such that they increase the lower opening of the control gate 7. Thereby, the in-feed rate to the gap 3 is once more increased to the operational in-feed rate. Additionally, the control unit 17 sends a fourth output signal to the gap adjuster 15, prompting the hydraulic cylinder 16 of the gap adjuster 15 to retract, thereby moving the rollers 2 towards each other, and hence, once more reducing the gap 3 to the operational width.

The skilled person realizes that a number of modifications of the embodiments described herein are possible without departing from the scope of the invention, which is defined in the appended claims.

For instance, the second metal detector may be dispensed with. Instead, the determination that the uncrushable object has passed may be based on probability. When a predetermined time measured by a timer in the control unit has passed after the first metal detector detected the presence of an uncrushable object, it may be assumed that the uncrushable object has passed through the gap. The predetermined time may be determined based on experimental data or calculated from the in-feed rate.

Further, the detectors used need not be metal detectors. If the roller crusher is to be protected not from metallic objects, but from overly large objects, a photocell or a radar equipment could be used for detecting objects that extend a predetermined height above an admissible height on the conveyor.

The in-feed arrangement need not necessarily comprise a conveyor belt, but may employ another kind of conveyor, such as a screw conveyor or a chute.

The discharge arrangement may take other forms than the one shown in the drawings, and may for instance comprise a conveyor belt onto which the crushed material is dropped.

The control gate need not be in the form of a funnel having pivotable sidewalls. For instance, a funnel having a circular cross-section and flexible walls may be used, the restriction of the lower opening of the control gate being adjustable through a snare-like arrangement around the funnel.

The hydraulic cylinder of the gap adjuster may also be used for controlling the gap width for adjustment to different compositions of the material to be ground.

The gap adjuster may, instead of a hydraulic cylinder employ other mechanical means, such as gears and a gear rack.

The adjustment of the width of the gap may be done by moving one of the rollers away from the other roller, which remains stationary, or by moving the two rollers away from each other.

It should be noted that the operational in-feed rate and the operational gap width are normally not fixed, but adjustable depending on the material to be ground.

Although the detector in the embodiment shown is illustrated as being arranged adjacent the in-feed conveyor, the detection of uncrushable objects could be done elsewhere in the in-feed stream of material to the roller crusher, e.g., at the rollers.

The invention claimed is:

1. A method of protecting a roller crusher from uncrushable objects, said roller crusher having two generally parallel rollers arranged to rotate in opposite directions and separated by a gap, said method comprising the steps of:

detecting an uncrushable object in an in-feed stream of material to said roller crusher, opening said gap between said rollers to a by-pass width, which is significantly larger than an operational width, such that said uncrushable object is permitted to pass through said gap, restricting an in-feed to said gap, such that material is fed to said gap at a restricted in-feed rate, determining that said uncrushable object has passed through said gap, reducing said gap to said operational width, and opening said in-feed to said gap, such that material is fed to said gap at an operational in-feed rate.

2. A method as claimed in claim 1, wherein said uncrushable object comprises metal.

3. A method as claimed in claim 1, wherein said by-pass width is greater than or equal to three times said operational width.

4. A method as claimed in claim 1, wherein said restricted in-feed rate is 30-50% of said operational in-feed rate.

5. A method as claimed in claim 1, wherein determining that said uncrushable object has passed through said gap comprises detecting said uncrushable object in a discharge stream of material from said roller crusher.

6. A roller crusher having two generally parallel rollers arranged to rotate in opposite directions and separated by a gap, said roller crusher comprising:

an in-feed arrangement arranged to feed material to said roller crusher, a control gate arranged to control an in-feed rate to said gap, a first detector arranged to detect uncrushable objects, a gap adjuster arranged to adjust a width of said gap, and a control unit arranged to receive at least one input signal from said first detector, and to transmit at least one output signal to said control gate and to said gap adjuster.

7. A roller crusher as claimed in claim 6, wherein said first detector is a metal detector.

8. A roller crusher as claimed in claim 6, further comprising a second detector arranged to detect uncrushable objects.

9. A roller crusher as claimed in claim 8, wherein said second detector is a metal detector.

10. A roller crusher as claimed in claim 8, wherein said first detector is arranged to detect uncrushable objects in an in-feed stream of material to said roller crusher, and wherein said second detector is arranged to detect uncrushable objects in a discharge stream of material from said roller crusher.

11. A roller crusher as claimed in any claim 6, wherein said gap adjuster is arranged to adjust said gap in a width range from an operational width to a by-pass width, which is significantly larger than said operational width, preferably greater than or equal to three times said operational width.

12. A roller crusher as claimed in claim 6, wherein said control gate is arranged to control said in-feed rate in a range from a restricted in-feed rate to an operational in-feed rate, said restricted in-feed rate being 30-50% of said operational in-feed rate.

13. A roller crusher as claimed in claim 6, wherein said control unit is arranged to transmit a first output signal to said control gate, and to transmit a second output signal to said gap adjuster.

14. A roller crusher as claimed in claim 6, wherein said control gate is hydraulically operable.

15. A roller crusher as claimed in claim 6, wherein said gap adjuster is hydraulically operable.

* * * * *